United States Patent [19]

Williams

[11] Patent Number: 4,522,343

[45] Date of Patent: Jun. 11, 1985

[54] MICRONIZED GRINDING APPARATUS

[75] Inventor: Robert M. Williams, Ladue, Mo.

[73] Assignee: Williams Patent Crusher and Pulverizer Company, St. Louis, Mo.

[21] Appl. No.: 448,950

[22] Filed: Dec. 13, 1982

[51] Int. Cl.[3] ..... B02C 15/02; B02C 15/08; B02C 23/40

[52] U.S. Cl. ..... 241/58; 241/61; 241/110; 241/124; 241/129

[58] Field of Search ..... 241/53, 56, 57, 58, 241/61, 62, 110–119, 39, 124–129

[56] References Cited

U.S. PATENT DOCUMENTS

| | | | |
|---|---|---|---|
| 1,769,352 | 7/1930 | Libbey | 241/58 X |
| 1,781,572 | 11/1930 | Drummond | 241/58 X |
| 2,200,489 | 5/1940 | Cook | 241/58 |
| 2,601,954 | 7/1952 | Crites | 241/133 |
| 2,815,903 | 12/1957 | Crites | 241/118 |
| 2,909,330 | 10/1959 | Hardinge | 241/19 |
| 3,337,142 | 8/1967 | Williams | 241/130 |
| 4,022,387 | 5/1977 | Williams | 241/130 |
| 4,056,233 | 11/1977 | Fay | 241/39 |
| 4,264,041 | 4/1981 | Kitto, Jr. et al. | 241/119 X |

*Primary Examiner*—Mark Rosenbaum
*Assistant Examiner*—Timothy V. Eley
*Attorney, Agent, or Firm*—Gravely, Lieder & Woodruff

[57] ABSTRACT

Apparatus for grinding coal to micron fineness having a grinding chamber with a grinding surface supported by a circumferential wall in the grinding chamber, a plurality of grinding rolls orbiting in the grinding chamber for grinding the coal, air supply bustle surrounding the grinding chamber, air flow restrictor means opening from the air supply bustle to the grinding chamber to create a back pressure in the air supply bustle for substantially evenly distributing the air supplied to the grinding chamber around the circumference of the grinding chamber, and wherein the restrictor means directs the air flow tangentially relative to the circumferential wall of the grinding chamber so that the coal particles are caught up in a cyclonic movement having a large initial horizontally directed force to maintain a body of coal particles in the orbit of the grinding rolls, which horizontal force gradually diminishes as the vertical force component of the air flow lifts the ground coal particles out of the grinding chamber.

3 Claims, 4 Drawing Figures

H2
V
C
H1
57
58
54
54
52
56
55
53
10
32
31
35
28
30
35
27
26
36
36
22A
22
37
39A
33
42
37
39
47
50
38
41
19
38
50
2
2
46
44
43
43
44
46
11
24
21
45
20
23
17
25
13
15
16
18
12
13
14

MICRONIZED GRINDING APPARATUS

BACKGROUND OF THE INVENTION

1. Field of the Invention

This invention pertains to micronized grinding apparatus and is directed to means for improving the ability of such apparatus to produce a product having a substantially uniform micronized product output.

2. Description of the Prior Art

A prevailing construction of roller grinding mill comprises a frame defining a grinding chamber provided with a bull ring against which a set of orbiting rollers crushes the material by application of controlled centrifugal force exerted by the rolls as they orbit and also roll relative to the bull ring. An air bustle surrounds the grinding chamber portion of the frame and generally radially oriented ports open between the bustle and grinding chamber below the bull ring for fluidizing and effecting movement of material upwardly into the orbit of the grinding rollers. Such a construction is seen in Williams U.S. Pat. No. 4,022,387 of May 10, 1977, as well as in Williams U.S. Pat. No. 3,337,142 of Aug. 22, 1967.

Another type of roller pulverizing mill is seen in Hardinge U.S. Pat. No. 2,909,330 of Oct. 20, 1959 in which the grinding rollers do not orbit but are caused to roll over material fed upon a rotating plate or fed into a bowl. Air is delivered below the rotating plate or bowl and passes up about the outside thereof to lift material which reaches the periphery of the plate or bowl. Other similar mills are seen in Crites U.S. Pat. Nos. 2,601,954 of July 1, 1952 and 2,815,903 of Dec. 10, 1957.

A problem evident in the prior art is that material fed into the grinding chamber is allowed to set up an eccentric distribution so vibration occurs which is detrimental to such apparatus. Uneven grinding and crushing results from this vibration, a high noise level is reached, and capacity of the mill output is reduced. Fine ground material such as coal, has a mass which allows ready transportation in the air stream behind the grinding rolls and out of the top of the grinding chamber.

BRIEF DESCRIPTION OF THE INVENTION

A principal object of the present invention is to obtain a more uniform distribution of material and position this bed of material in the grinding chamber so that the grinding action of the rolls against the bull ring can produce a greater uniformity of fineness of the order of a few microns in diameter.

Another object of the present invention is to introduce air into the grinding chamber so it can impart a spinning action to develop a horizontal component to the coal to establish a mass of the coal in the orbit of the rollers, and to substantially evenly distribute the air and coal about the grinding chamber through passages which direct the air flow tangentially below the bull ring.

An additional object of the present invention is to obtain a substantially even distribution of air in a tangential spin in the grinding chamber for forming a bed of material between the rolls and the bull ring to overcome contact of the rolls on the bull ring and thereby improve the capacity of the mill.

A presently preferred embodiment of the roll mill apparatus comprises air flow directing passages in the air supply bustle positioned to impart a spin to air entering the grinding chamber below the level of the grinding rolls so that the spin created in the chamber exerts a horizontal component of force which concentrates the fine material at the outer zone of the chamber, and the larger material is induced to migrate into the grinding zone. After grinding, the fines are spin lifted by the vertical component of the air stream to where separation of oversize material takes place at the dynamic separation location.

BRIEF DESCRIPTION OF THE DRAWINGS

An embodiment of the present invention which illustrates a construction which has overcome problems present in prior art mills is seen in the following drawings.

DETAILED DESCRIPTION OF THE EMBODIMENT

Figures 1, 3:
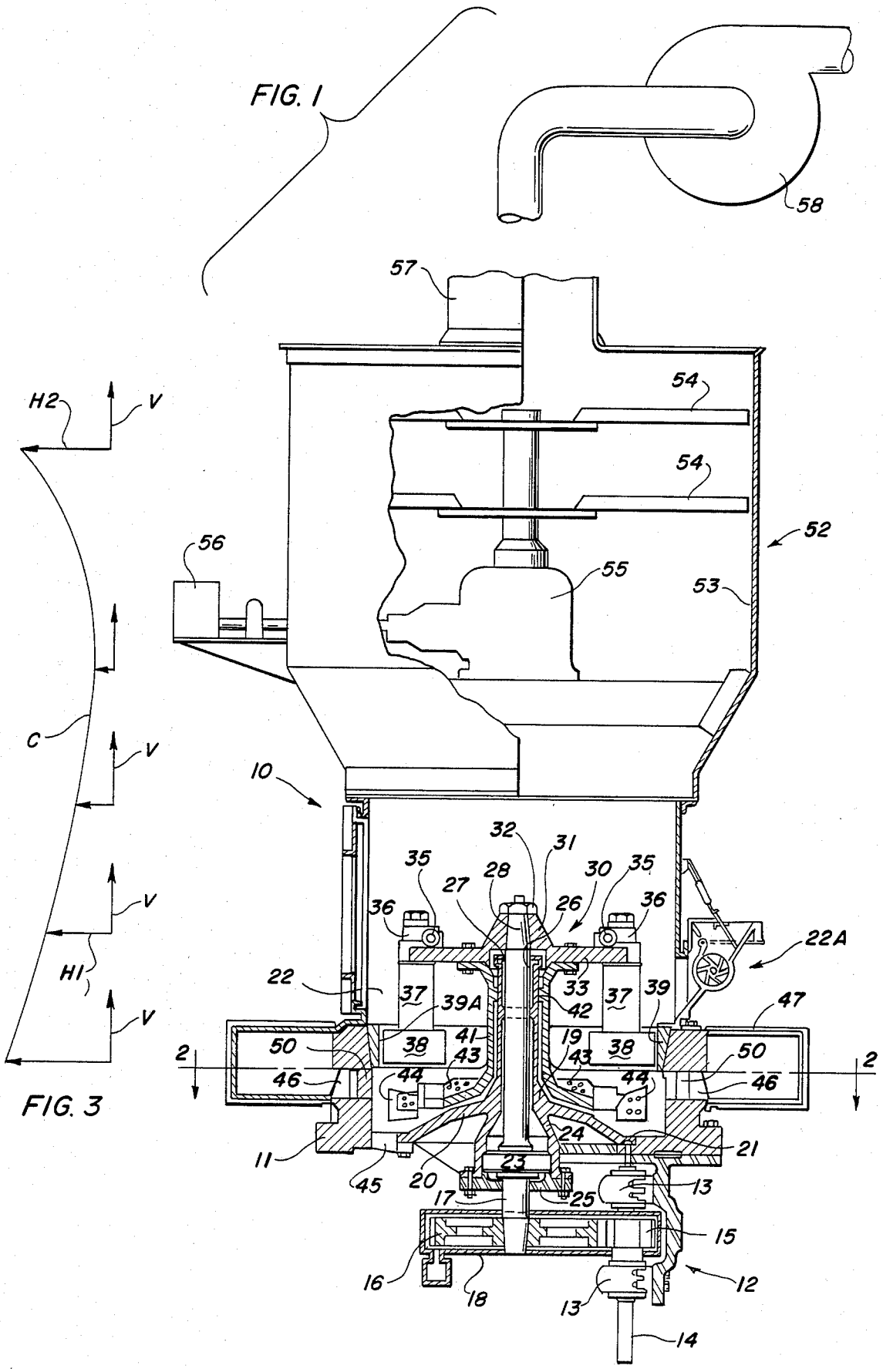
FIG. 1 is a sectional elevational view of a roller grinding mill exhibiting the characteristic features of the invention.
FIG. 3 is a vector diagram to illustrate the forces acting on the material as it moves in the apparatus.
Figure 2:
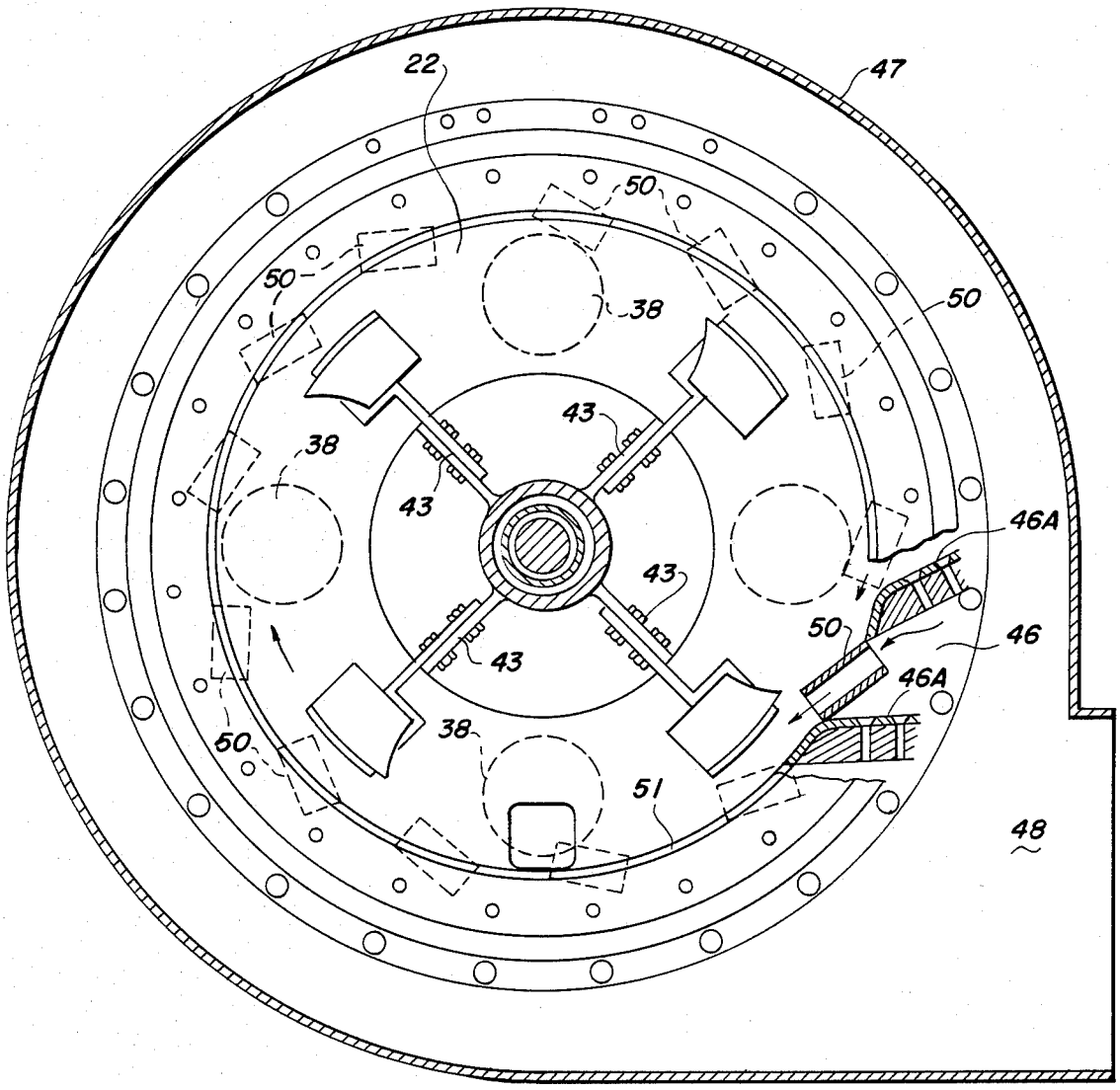
FIG. 2 is a transverse sectional view of the mill construction as seen along line 2—2 in FIG. 1
Figure 4:
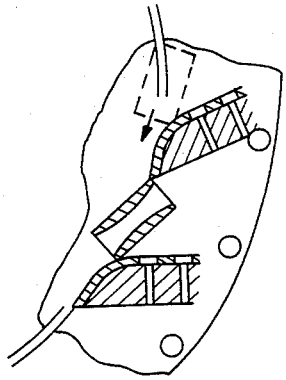
FIG. 4 is a fragmentary sectional view showing a venturi flow restrictor.

The present roller mill assembly seen in FIGS. 1 and 2 embodies a main frame structure 10 formed with a mounting flange 11 by which the frame may be supported on a suitable base (not shown). The frame 10 carries a sub-structure 12, shown only fragmentarily in FIG. 1, for the purpose of supporting the bearings 13 for a power input shaft 14 which drives a gear 15. The gear 15 drives a speed reducing gear 16 fast on a drive shaft 17. The gears 15 and 16 are mounted in a suitable casing 18 for protection. The drive shaft 17 extends vertically upwardly through a fixed column 19 which is formed with a bell bottom wall 20 having its circumferential lip 21 mounted in the frame 10 for support and to close the bottom of a grinding chamber 22. Coal feeder gate means 22A opens to chamber 22.

The shaft 17 is supported in a thrust bearing assembly 23 carried in a socket 24 depending from the under side of the bell bottom wall 20. The socket is closed by a removable closure plate 25. As the drive shaft 17 passes upwardly through the column 19 it is stabilized by a guide sleeve 26 supported on a rib projecting inwardly to support the sleeve. A seal element is held in place on the rib at the lower end of the sleeve 26. The upper end of the column 19 is provided with a lubricant reservoir 27 surrounding the portion of the shaft just below its projecting tapered end 28. A head member in the form of a spider structure 30 has a central hub 31 engaged on the tapered end 28 of shaft 17 and held by a nut 32 so that the head member 30 rotates with the shaft.

Referring to FIG. 1, the head member 30 has a plurality of arms 33 (two being shown). Each arm carries bearings 35 and a hanger trunnion 36 is pivotally carried by bearing 35 for the purpose of supporting a hanger shaft 37 which depends to a level for carrying a grinding roller 38. The level of the grinding rollers 38 is surrounded by a bull ring 39 which is fixed in a tapered seat in the frame 10 and presents an inward grinding face 39A to the rollers.

In FIG. 1 it can be seen that the head member 30 is attached at its under side to the top flange 40 of a tubular shaft 41 which surrounds the column 19 and has a stabilizing shoulder 42 engaged about the column 19. The lower end of the tubular shaft 41 is flared outwardly to provide arms 43 to support plow blades 44. The arms are oriented relative to the grinding rollers 38 so that a plow blade 44 preceeds a grinding roller 38 so that the material to be ground will be thrown upwardly into the path of travel of the rollers 38 at the level of the bull ring 39. Thus, the plows 44 rotate in a space below the grinding rollers 38, such space having its bottom defined by the bell bottom 20. An aperture 45 is provided in the bottom of this space for the discharge of a portion of the material being processed, such as tramp metal and hard to grind components.

In operation, it can be understood that each hanger shaft 37 and its roller is free to pivot radially inward toward the center column 19, and the roller is forced by centrifugal action upon rotation of the shaft 17 and head member 30 radially toward the fixed bull ring 39. It is undesirable to allow the roller 38 to engage the bull ring, and prior mills had of necessity to supply sufficient material to always have a layer of such material between the rolls and the bull ring to prevent metal-to-metal contact. If contact is obtained the result is vibration and noise of an extreme intensity such that the mill will self-destruct if not shut down.

Turning now to FIG. 2, it can be seen that the grinding chamber 22 is enclosed by the wall 51 of the frame structure 10, and has the bottom wall 20 over which plows 44 travel during rotation. The bottom wall is formed with a throw-out opening 45 where tramp iron and hard to grind material can drop out of the chamber 22. The frame 10 is formed with a plurality of openings 46 which connect the chamber 22 with a wind box or air bustle 47 which surrounds and encloses the frame 10, at least at the level of the openings 46. Air is admitted to the bustle 47 at inlet 48. In the prior constructions the air is allowed to flow into openings 46 in a more or less random way so that turbulence is created in the grinding chamber.

The turbulence is due to the fact that the ports 46 provide a large opening which allows the air entering the bustle 47 to enter the nearest ports 46 while the ports farthest from the inlet 48 are starved for air. The result is that the uneven distribution of air flow into the grinding chamber basically moves inward toward the central area behind the rolls 28, and this has resulted in reducing the mill output by causing uneven presence of material between the rolls 38 and the bull ring 39.

According to the present invention greatly improved mill output and substantially more even consistency of micronized particle size is achieved by the arrangement of air directing passage forming means 50 secured in each opening 46 creating a venturi effect. The means 50 is shown as a straight flow restrictor means, but can have a somewhat restricted throat like a venturi to produce the velocity flow increase usually associated with the venturi. It is thought unnecessary to show more than one flow restrictor 50 in full line, even though there are a plurality of such restrictor means. These restrictor means 50 are aligned so the axis thereof is directed to be tangent to the chamber wall 51. To achieve the desired result, each restrictor means 50 is positioned in its respective opening 46 so as to be supported by the liners 46A which are bolted to the frame 10. The restrictor means 50 collectively impose a back pressure in the bustle 47 by reducing the area of each opening 46, thereby developing a substantially even delivery of air around the chamber 22 with an increase in the velocity of the air in the restrictor means to approximately 3000 fpm. Furthermore, the axis of each restrictor means 50 is tangent to the circle of the wall 51 causing the air to spin rapidly in a clockwise direction. This spinning action of the air imparts a centrifugal force or horizontal component to the coal particals and organizes the material in the chamber so that an adequate bed of material can be lifted by the upward or vertical component of the air flow, to thereby maintain the material between the rolls 38 and the bull ring 39 to overcome contact of the rolls on the bull ring. This function of the restrictor means 50 greatly improves the capacity of the mill and reduces the noise and vibration. A mill so equipped is able to pulverize material, such as pre-crushed coal so that 98% of the output has a fineness of substantially 98 minus 325 mesh, or about 44 microns.

An important characteristic of the present apparatus is depicted in FIG. 3 to illustrate the forces acting on the material being ground to fineness of the order of 44 microns. When the material is coal it needs to be pre-crushed. FIG. 3 is a vector diagrapm which corresponds to the various levels within the apparatus 10 and 52. As shown, the horizontal force vector H at the level of the restrictor means 50 is greater than the vertical force vector V, but the horizontal vector varies as shown by curve C. The effect of this is to move the material entering at inlet means 22A to the outer limits of the grinding chamber where the vertical force vector can cause it to pass between the bull ring 39 and the rolls 38. As the mass of material is ground it is lifted above the rolls 38 where the horizontal vector force H1 has decreased in relation to the vertical vector force V which does not change. Following along the curve C for the horizontal vector force values, it is seen that the horizontal force values decrease until the material enters the spinner separator and is subjected to the centrifugal fan action of the blades 54 which increases the horizontal vector H2. Thus, in the separator 52 the large particles are moved to the outer wall 53 and drop by gravity to again enter the grinding orbit of the rolls 38. The vertical vector force does not change as long as the blower speed is not changed.

As seen in FIG. 1, the output of the apparatus is delivered to a spinner separator 52 where the larger particles are caused to move to the outer wall 53 by the centrifugal fan action of the blades 54 driven by gear means 55 from a motor 56 support at the exterior. The larger particles thus separated fall by gravity back into the mill 10 and re-enter the mass of material being moved by the spinning action of the air induced by the restrictor means 50 through the orbit of the rolls 38 at the bull ring 39. The material of desired micronized fineness is discharged at outlet 57 and conveyed by a suitable blower 58 to a place of use. The blower which supplies the air to bustle 47 is the source of air to move the material in its spinning or cyclonic flow both horizontally and vertically. The blower 58 can be connected to the inlet 48 of the bustle 47, but for convenience of drawing disclosure, it has been connected to the outlet 57 of the spinner separator 52.

The foregoing apparatus avoids the problems of the older roller mill grinders in which a large portion of the material is able to bypass the orbit of the rollers as the air flow into the grinding chamber carries the fine coal behind the grinding elements and allowed it to exit behind the grinding zone. The present apparatus is arranged to process coal to such fineness that it can be employed as a substitute for oil or gas fired boilers. In boilers using oil or gas as the fuel there is no clogging of the spaces between the water tubes, but when coal is substituted the particles, if not micronized, will bridge the water tubes and clog the boiler.

The present apparatus is able to reduce the mass of coal to micronized fineness so the ash residue is also reduced. By grinding to a fineness of 98 minus 325 mesh, or about 44 microns, the coal is reduced to a condition like smoke so that it has a low particle mass. When so micronized the coal will suspend itself in oil and not settle out when mixed, thereby rendering coal as an acceptable auxiliary fuel source.

The action which takes place in the micronized grinding apparatus is believed to follow a pattern in which the air flow introduced at the several passages 50 will be given a centrifugal spin so that the coal particles which have been pre-crushed will be driven with a large radially directed horizontal component against the bull ring 39 where the grinding effort of the rolls 38 is maximized. At the same time, the air flow exerts a vertical component of motion on the coal particles to move the same into and through the spinner separator 52, with oversize particles caused to move out along the walls where it can migrate back to the grinding chamber for further reduction. As the micronized coal moves vertically above the orbit of the grinding rolls the horizontally directed component of the cyclonic motion decreases but the vertical component remains about the same in its lifting effect on the micronized coal particles. It should now be apparent that the present apparatus possesses the unique ability to process pre-crushed coal in a roller grinding apparatus such that the coal is given a cyclonic spin of such magnitude to concentrate a mass of the extremely small coal fractions to be ground between the bull ring 39 and the rollers 38 so it can be micronized as above noted for use as a substitute source of fuel. The spin imparted to the coal maintains the mass of coal in the grinding orbit while the vertical air flow introduces a lift vector that lifts the coal as it is reduced to the micron size range where it has greatly reduced mass making it responsive to the vertical flow of the air.

It should be further apparent from the foregoing disclosure of apparatus that an important improvement in roller grinding of coal is characterized by the provision of air flow restrictor means spaced around the periphery of the circumferential wall defining a grinding chamber so as to create a back pressure on the air in the air supply bustle for evenly distributing the air and directing it tangentially into the grinding chamber so that vector forces acting horizontally and vertically on the coal particles initially have a greater horizontal force to maintain a body of the coal particles in the orbit of the grinding rollers for reducing the coal particles to such fineness that it has a greatly reduced mass making it responsive to the vertical vector forces of the air flow out of the grinding chamber.

What is claimed is:

1. In an apparatus for grinding coal to micron fineness in a grinding chamber having a circumferential wall supporting a grinding surface, grinding rolls operably mounted in the grinding chamber to grind coal against said grinding surface, means for introducing coal to said grinding chamber, air bustle means surrounding the grinding chamber and receiving a supply of air, and a plurality of openings to and spaced around the circumferential wall of the grinding chamber, the improvement characterized in the mounting of air flow restrictor means in the circumferential wall openings, all of said restrictor means comprising tubes having a somewhat restricted throat like a venturi thereby presenting openings between the air bustle and the grinding chamber for directing the air flow at increased velocity into a like number of horizontal streams substantially tangentially along the circumferential wall and to cause rapid spinning of the mass of the coal particles for substantially evenly distributing coal and air along the grinding surface, and said restrictor tubes creating a back pressure on the air in the air bustle to substantially evenly distribute the air throughout the air bustle and direct the air flow at said increased velocity into the grinding chamber so as to force the mass of the coal particles to follow streams substantially tangential to the circumferential wall.

2. The improvement set forth in claim 1 characterized in that said air flow restrictor means are venturi tubes for increasing the velocity of the air flow between said air bustle and said chamber.

3. In a grinding apparatus for grinding precrushed coal to a micronized fineness and having a grinding chamber defined by a peripheral wall formed with air flow openings distributed substantially evenly around the peripheral wall and opening into the grinding chamber, grinding rolls orbiting in the grinding chamber, and an air receiving bustle surrounding the grinding chamber and enclosing the air flow openings, the improvement characterized in the arrangement of air flow directing means mounted in each of the peripheral wall air flow openings and being oriented in the peripheral wall air flow openings to impart a centrifugal spin and an increased velocity to the air as it enters the grinding chamber for presenting the mass of the coal in a substantially uniform distribution of such coal to said grinding rolls, whereby the increased velocity and centrifugal spin forces the coal movement into the orbit of the grinding rolls, and said air flow directing means in each of the peripheral wall air flow openings is a venturi tube for reducing the area of said flow openings and creating a back pressure in said bustle to assure said increased air flow velocity and centrifugal spin in the grinding chamber.

* * * * *